US010411371B2

(12) United States Patent
Pizzi

(10) Patent No.: US 10,411,371 B2
(45) Date of Patent: Sep. 10, 2019

(54) ASSEMBLY COMPRISING CONDUCTOR ELEMENT AND RESILIENT MEANS FOR UNIDIRECTIONALLY RETAINING ELECTRIC WIRES FOR SWITCHBOARD TERMINAL BLOCKS

(71) Applicant: MORSETTITALIA S.P.A., Milan (IT)

(72) Inventor: Giordano Pizzi, Milan (IT)

(73) Assignee: MORSETTITALIA S.P.A., Milan (IT)

( * ) Notice: Subject to any disclaimer, the term of this patent is extended or adjusted under 35 U.S.C. 154(b) by 0 days.

(21) Appl. No.: 16/028,547

(22) Filed: Jul. 6, 2018

(65) Prior Publication Data

US 2019/0013601 A1 Jan. 10, 2019

(30) Foreign Application Priority Data

Jul. 7, 2017 (IT) ..... 102017000076533

(51) Int. Cl.
*H01R 11/09* (2006.01)
*H01R 9/24* (2006.01)
(Continued)

(52) U.S. Cl.
CPC ..... *H01R 9/2416* (2013.01); *H01R 4/4818* (2013.01); *H01R 4/4827* (2013.01);
(Continued)

(58) Field of Classification Search
CPC ..... H01R 9/2416; H01R 9/24; H01R 9/26; H01R 9/2675; H01R 4/4818;
(Continued)

(56) References Cited

U.S. PATENT DOCUMENTS 7,575,486 B2 * 8/2009 Weber ..... H01R 43/16 439/811
7,938,693 B2 * 5/2011 Skowranek ..... H01R 4/42 439/811
2005/0029003 A1 2/2005 Conrad et al.

FOREIGN PATENT DOCUMENTS

DE 202005005369 U1 3/2006
EP 2110886 A2 10/2009

OTHER PUBLICATIONS

Search Report for Related Italian App. 102017000076533 dated May 9, 2018.

* cited by examiner

*Primary Examiner* — Khiem M Nguyen

(57) ABSTRACT

Conductive assembly for switchboard terminal blocks comprising a conductor element (200) for electrically connecting together the input and output (IN/OUT) of a switchboard terminal block, and resilient means for retaining electric wires (1) comprising at least one resilient element (100) with a body (110) having a first arm (111) substantially parallel to the vertical direction (Z-Z) and a second arm (112) forming an acute internal angle with the first vertical arm (111), which arms are resiliently connected together by a curved section (113), said conductor element (200) having a substantially U-shaped form and arms (211) which extend parallel to a substantially vertical direction (Z-Z) and are situated opposite each other in the longitudinal direction (X-X), wherein the conductor element comprises a pair of shoulders (212), each extending from the base (212) parallel to the vertical direction (Z-Z) and arranged facing, at a suitable distance, a respective vertical arm (211) of the conductor element.

(Continued)

Figure 4:
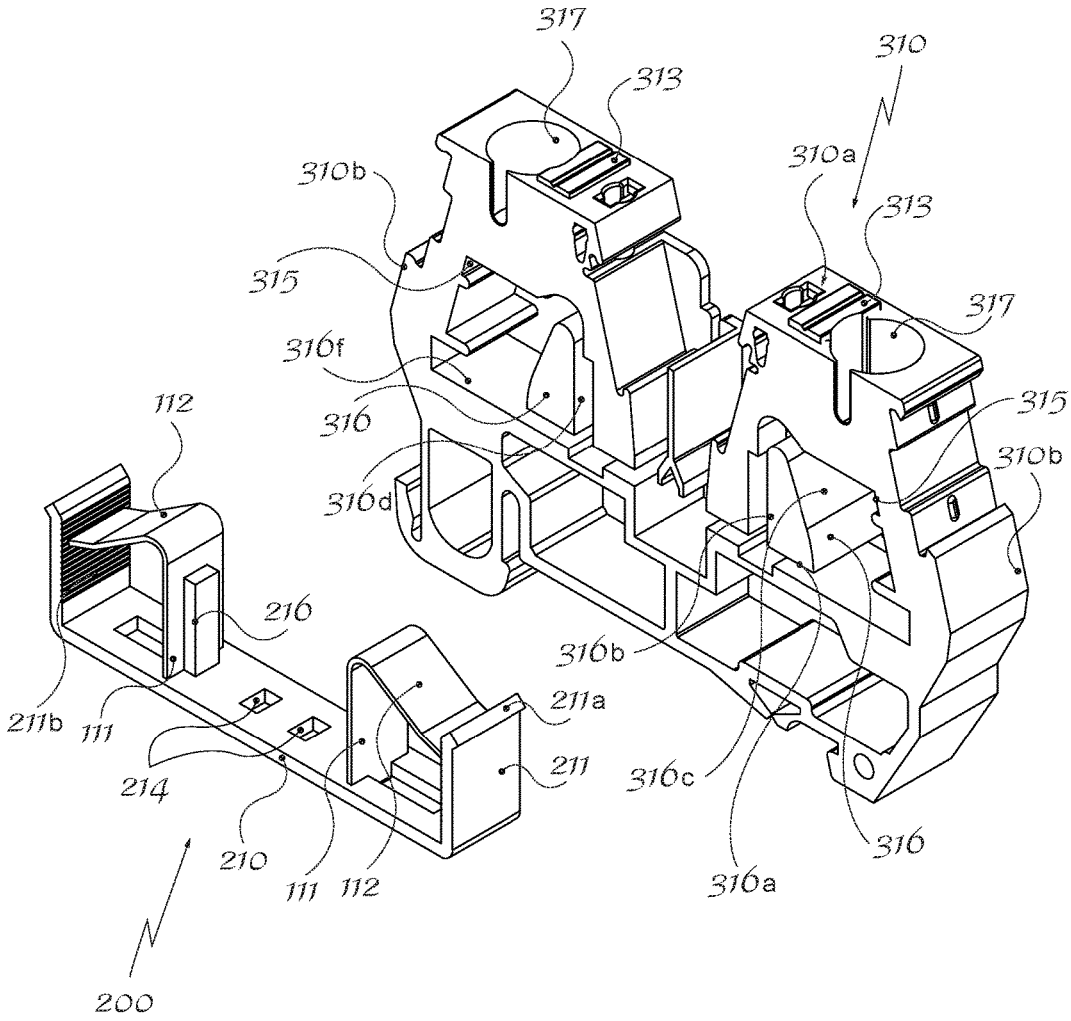

The first arm (111) of the at least one resilient element (100) has a substantially L-shaped foot (115) comprising a lug (115*b*) bent in the longitudinal direction (X) outwards.

13 Claims, 3 Drawing Sheets

(51) Int. Cl.
*H01R 4/48* (2006.01)
*H01R 9/26* (2006.01)
*H01R 25/14* (2006.01)

(52) U.S. Cl.
CPC ..... *H01R 4/4836* (2013.01); *H01R 4/4845* (2013.01); *H01R 9/24* (2013.01); *H01R 9/26* (2013.01); *H01R 9/2675* (2013.01); *H01R 25/142* (2013.01)

(58) Field of Classification Search
CPC .. H01R 4/4827; H01R 4/4836; H01R 4/4845; H01R 25/142
USPC ..... 439/709, 723
See application file for complete search history.

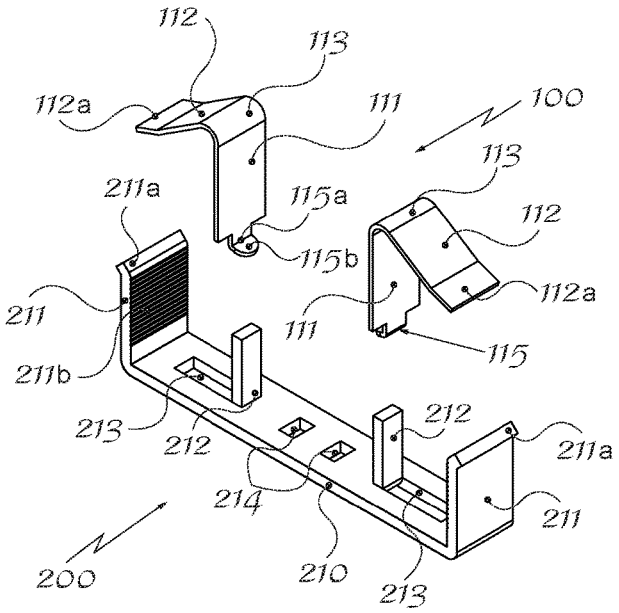
Fig. 1
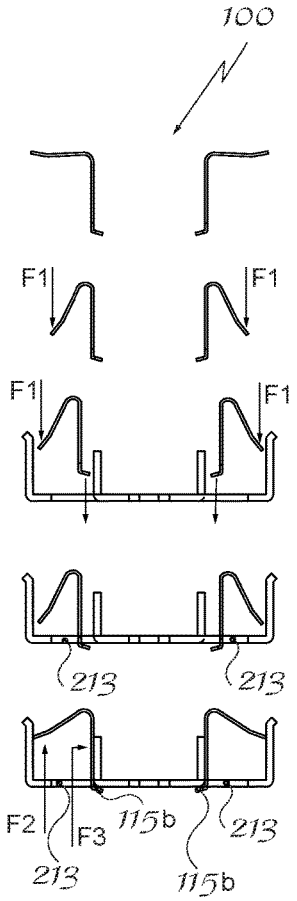
Fig. 2
Fig. 3
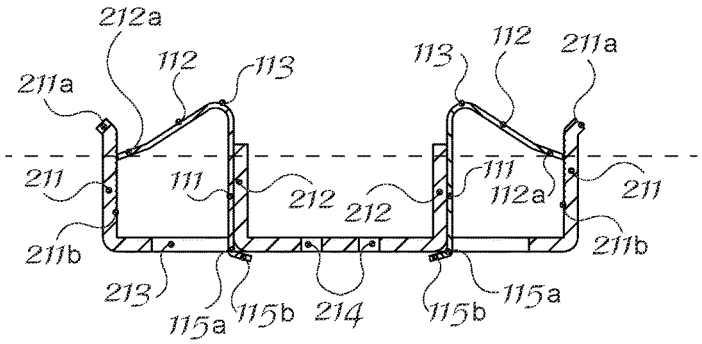

ASSEMBLY COMPRISING CONDUCTOR ELEMENT AND RESILIENT MEANS FOR UNIDIRECTIONALLY RETAINING ELECTRIC WIRES FOR SWITCHBOARD TERMINAL BLOCKS

The present invention relates to an assembly comprising a conductor element and resilient means for unidirectionally retaining electric wires for switchboard terminal blocks.

It is known in the technical sector relating to electrical connection devices such as terminal strips, connection boxes and the like to use terminal blocks adapted to be mounted on associated supports and to provide access on the front to the means—normally of the screw type—for retaining the connecting wires which form the electrical circuit.

It is also known that said means for retaining the end of the electric wire comprise, among other things, also means for gripping the wire, formed by a resilient strip which, during use, must engage with a conductor element arranged inside the terminal block and able to electrically connect the input and the output of the said terminal block; said resilient means comprise essentially a strip which is deformed by means of compression so as to allow opening of a slit and the entry of the wire into its seat; once insertion has been completed, the strip is released and returns elastically into its rest position, causing the wire to be gripped against the counteracting electrical connection element.

Examples of such prior art are described in EP 2 110 886 in the name of the present Applicant. Although fufilling their function, these known gripping means have, however, drawbacks arising mainly from the U-shaped form of their base for engagement with an input/output connection conductor element of the terminal block, said form requiring a large number of bending operations during production as well as a succession of at least three movements when engaging the resilient strip with the conductor element, with a consequent increase in the downtime and the possibility of errors which in turn result in incorrect operation of the finished and installed terminal block and therefore high overall costs.

In addition to the above it also happens that the conductor element and the resilient retaining means do not form, when joined together, a stable assembly since the forces which stabilize the assembly are generated only when the assembly is inserted inside the terminal block which is suitably shaped internally with contact and reaction surfaces for the two elements.

This instability of the assembly therefore results in further complications due to the fact that the assembly may not be safely handled separately from the plastic body of the terminal block, thus preventing production, storage, packaging and despatch thereof as an independent unit.

DE 20 2005 005 369 U1 describes a conductive assembly according to the preamble of Claim 1, which requires complicated and costly connecting structures for retaining a spring on a conductor element.

The technical problem which is posed therefore is that of providing a conductive assembly for connecting the input/output of switchboard terminal blocks, which allows stable engagement with resilient means for retaining the electric wires inserted inside the said terminal block.

The problem which is also posed is that of providing an assembly comprising a conductor element and resilient means for retaining electric wires which can be preassembled and as such is applicable by means of simple insertion inside a switchboard terminal block.

These results are obtained according to present invention by an electrical connection conductive assembly for a switchboard terminal block according to the characteristic features of Claim 1.

In connection with this problem it is also preferably required that this conductor element and conductive assembly should have small dimensions, be easy and inexpensive to produce and be able to allow engagement by means of a small number of assembly operations.

Figure 5:
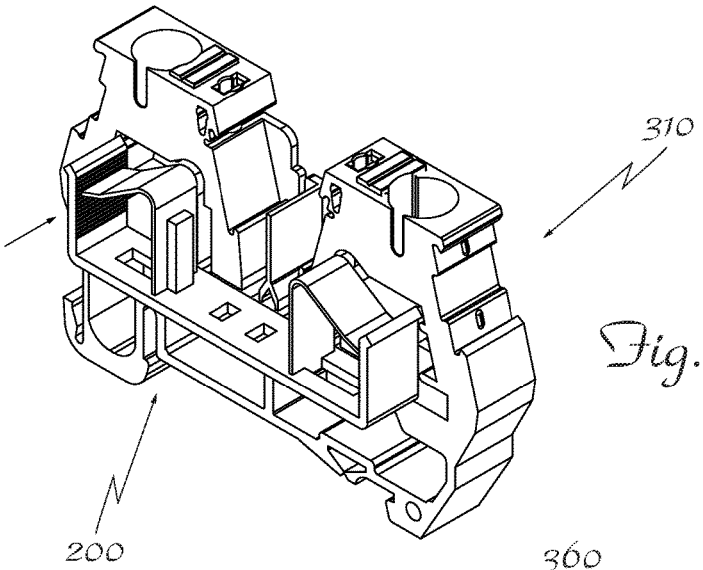
Figure 6:
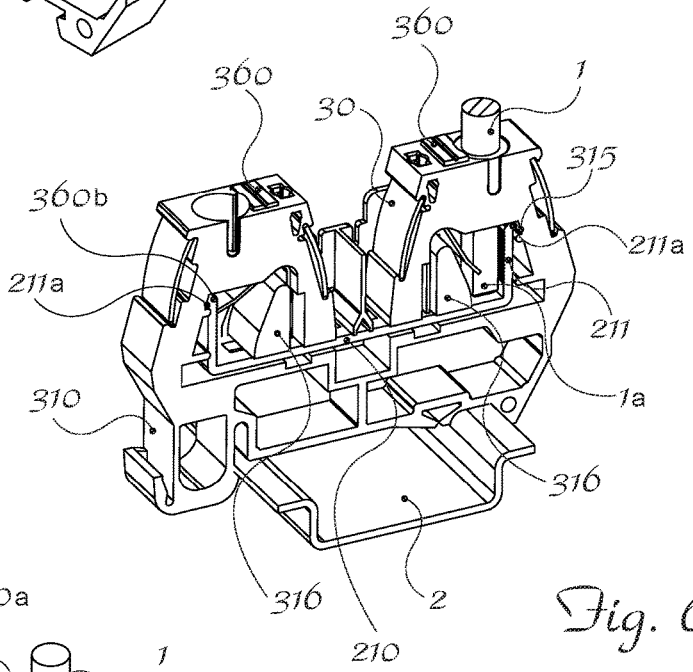
Figure 7:
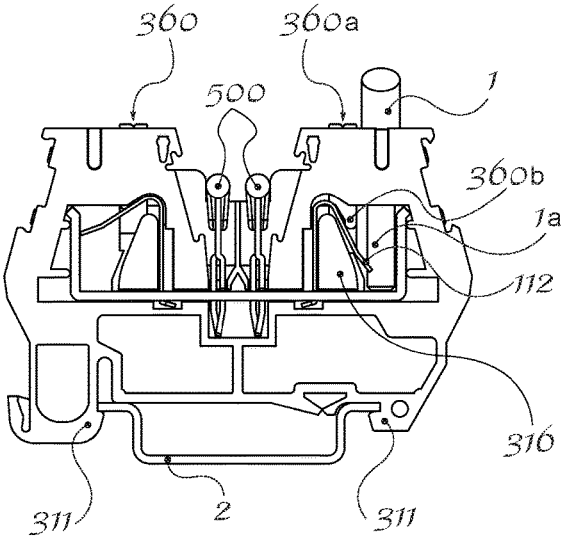

Further details may be obtained from the following description of a non-limiting example of embodiment of the subject of the present invention provided with reference to the attached drawings in which:

FIG. 1: shows an exploded perspective view of a conductor element of the assembly according to the invention and the resilient means for retaining electric wires to be connected to the conductor element;

FIG. 2: shows front views of the sequence for engaging the various parts in order to form the stable conductive assembly;

FIG. 3: shows a schematic cross-sectional view of the assembly comprising the conductor element and the resilient means connected together;

FIG. 4: shows an exploded perspective view of a terminal block and the conductive assembly according to the invention;

FIG. 5: shows a perspective view of a terminal block and the conductive assembly according to the invention during insertion of the latter inside the former;

FIG. 6: shows a view similar to that of FIG. 4 once insertion has been completed; and FIG. 7: shows a view of the terminal block according to FIG. 5 with jumpers inserted inside the terminal block.

As shown in FIG. 1 and assuming solely for the purpose of easier description and without any limitation of meaning a set of three reference axes in a longitudinal lengthwise direction X-X, transverse widthwise direction Y-Y of the conductor element 200 and vertical heightwise direction Z-Z perpendicular to the other two directions, the assembly according to the invention for performing electrical conduction and mechanically retaining wires for electric switchboard terminal blocks comprises essentially a conductor element 200 and resilient means 100 for retaining electric wires 1 inserted inside a terminal block 310.

In detail:

the resilient means 100—referred to below in short as "spring 100"—for retaining electric wires 1 according to the present invention comprise a body 110 with a first arm 111 substantially parallel to the vertical direction Z-Z and a second arm 112 forming an acute internal angle with the first vertical arm 111;

the two arms 111,112 are connected together by a curved section 113 designed to produce a resilient reaction of the second arm 112 with respect to the first arm 111 in the event of relative deformation due to external forces.

The second arm 112 has preferably a free end 112*a* inclined in the vertical direction Z-Z with respect to the said second arm.

The first vertical arm 111 has at its free end 111*a* a substantially L-shaped foot 115 comprising a vertical section 115*a* and a lug 115*b* bent in the vertical direction Z-Z outwards, with respect to the vertical section 115*a*.

The length of the vertical section 115*a* of the foot 115 is preferably slightly greater than the thickness of the base 210 of the conductor element 200.

the conductor element 200 for electrically connecting the input/output of a terminal block described below (FIG.

4) has a substantially U-shaped form with substantially vertical arms 211 situated opposite each other in the longitudinal direction X-X and a horizontal connection base 210.

said horizontal connection base 210 has first slots 213 each configured to receive a foot 115 of the spring, in particular having a transverse dimension slightly bigger than the transverse dimension of the foot 115 of the spring 100.

The free end 211*a* of the vertical arms 211 of the strip 200 is preferably bent outwards at an obtuse angle so as to form a tooth 211*a* able to be inserted inside a corresponding seat 315 of a terminal block as will emerge more clearly below.

Preferably, the inner surface of each vertical arm 211 has a knurled zone 211*b* suitable for engagement with the free end 112*a* of the second arm 112 of the spring 100.

According to the preferred embodiment shown, the conductor element 200 is open in the transverse direction Y-Y with a cross-sectional form along a plane X-Z which reproduces the form of a U with arms perpendicular to the base (FIG. 3).

According to the invention it is envisaged that the conductor element 200 has a pair of shoulders 212 each extending parallel to the vertical direction Z-Z and facing in the longitudinal direction X-X a vertical arm 211 of the said conductor element.

The length, in the vertical direction Z-Z, of each shoulder 212 and the distance in the longitudinal direction X-X from the associated vertical arm are respectively determined on the basis of the dimensions of the first arm 111 and second arm 112 of the resilient element 100 for retaining the electric wire as will emerge more clearly below.

Preferably, the shoulders 212 are obtained by folding a base section of the conductor element so as to form at the same time the opening 213, passing through in the vertical direction Z-Z, suitable for allowing insertion of the foot 115 of the spring 100. This facilitates further the production of the conductor element 200.

It will evident, however, to the person skilled in the art that the element 200 may also be obtained in other ways, for example by welding the shoulders 212 onto the base.

It is also preferable in this connection that the slots 213 should have a longitudinal extension greater than the transverse extension so as to ensure an optimum height of each shoulder 212.

Preferably, the base of the conductor element also has openings 214 suitable for engagement with jumpers 500 for connecting several terminal blocks in the transverse direction Y-Y.

As shown in FIG. 2 the mounting sequence of the conductor element 200/spring 100 assembly comprises:

folding a flat strip so as to form the first arm 111, the second arm 122 of the spring as well as the foot 115 thereof;

forming the conductor element 200 with the associated elements comprising: the base 210, the end arms 211, 211*a*, the shoulders 212 and the openings 213;

applying a force F1 in the vertical direction Z-Z on the free end 112a of the inclined arm 112 in order to obtain resilient bending thereof inwards (first arm 111);

mounting in the vertical direction the spring 100 onto the conductor element 220 by inserting the foot 115 inside the opening 213 of the base 210 until the lug 215*b* has passed beyond the thickness of the base 210;

releasing the second arm 112 which, owing to the resilient reaction F2 caused by the pre-tensioning force of the connecting section 113, positions the free end of the second arm against the inner surface 211*b* of the arm 212, causing both engagement and therefore locking thereof and a simultaneous thrust F3 in the longitudinal direction X-X towards the central part of the base 210, said thrust causing the first arm 112 of the spring 100 to come into contact with the shoulder 212 and the lug 115*b* of the foot 115 to engage underneath the said shoulder;

as shown in FIG. 3, the spring 100 is thus stably, but reversibly locked together with the conductor element, forming a stable conductive assembly which can be handled without the risk of accidental disassembly and can therefore be easily inserted inside the terminal block as shown in FIGS. 5, 6.

As shown by means of the broken line in FIG. 3, according to a particularly preferred embodiment of the conductive assembly the resilient element 110 is configured so that, in the condition where the assembly is assembled with the resilient element locked against the respective arm 211 and the shoulder 212, the point of action of the second arm 112 of the spring 100 on the respective arm 211 of the conductor element 200 is substantially at the same height in the vertical direction Z-Z as the reaction point of the first arm 112 of the spring 100 on the respective shoulder 212 of the conductor element. This preferred configuration ensures the maximum stability of the preassembled conductive assembly.

The length of the section 115*a* of the foot 115 in the vertical direction is preferably greater than the thickness of the base 210 of the conductor element 200 so that the bent lug 115*b* is engaged underneath the base when the conductor 200 and resilient element 100 are joined together (FIG. 3). The present invention relates also to a switchboard terminal block for connecting electric wires comprising:

an insulating body 310 forming the container of the assembly comprising resilient means 100 for retaining the free end 1*a* of the electric wire 1 and the conductor element 100 for electrically connecting together the input IN and output OUT.

In greater detail (FIG. 4), said insulating body 310 has a frame formed so as to define at least one front end side 310*a*, at least two respective flanks 310*b* arranged opposite to each other in the longitudinal direction, and means 311 for engagement with a DIN rail 2.

The following are formed inside the body 310:

a first pair of seats 312 open in the transverse direction Y-Y and symmetrical with respect to a central axis parallel to the vertical direction Z-Z;

a second pair of seats 315 respectively formed on the inner surface of each flank 310*b*, in turn symmetrical with respect to the axis Z-Z, open towards the respective first seat 312 and designed to receive a respective inclined free end 211*a* of the arm 211 of the contact conductor element 200 in order to stably retain said element inside the insulating body 310.

Each seat 312 has, arranged inside it, a substantially trapezoidal body 316 with its larger base 316*a* parallel to the longitudinal direction X-X, height 316*b* parallel to the vertical direction Z-Z and inclined face 316*c* directed towards the respective side face 310*b* of the terminal block; the body 316 is arranged inside the seat in a longitudinal position such as to form a first recess 316*d* designed to contain the shoulder 212 of the conductor element 200 and the first vertical arm 111 of the spring 100; and a second recess 316*f* designed to contain the second arm 112 of the spring 100; during use the inclined flank 316*c* of the body 316 forms an end-of-travel stop for resilient deformation of the said second arm 112 towards the first arm of the spring 100.

On the end wall 310*a* of the frame 310 the following are also formed:

- a pair of first openings 313 extending in the vertical direction Z-Z, substantially superimposed on the respective seat 312 in the vertical direction Z-Z and designed to place said seats in communication with the outside for introduction of a tool;
- a pair of holes 317 with a vertical axis Z-Z arranged in a more outer position with respect to said first openings 313 and connected to the respective seat 312 with which they communicate for introduction of the wire 1 in the vertical direction Z-Z.

Although not illustrated, assembly of the terminal block involves the following steps:

- removing a front cover matching and arranged opposite the frame 310,
- inserting (FIGS. 5, 6) in the transverse direction Y-Y the conductor element 200 already engaged with the spring 100 so that the inclined end 211*a*, the resilient means 100 for retaining the wire 1 and the vertical arm 122 of the base 210 are arranged inside the respective seats 316*d*,316*f*;
- closing the cover;
- applying force on the arm 112 of the spring 100 using a single standard tool inserted inside the hole 313 and pushing the end 112*a* away from the vertical arm 211 of the electric conductor 200;
- inserting the wire 1 inside the respective entry seat 317 so that the end 1*a* penetrates to the bottom of the seat 312;
- extracting the tool and releasing the second arm 112 of the spring 100 so that the arm, returning elastically into its original position, grips the wire ensuring firm contact with the vertical wall 211 of the conductor 200.

According to the invention it is also envisaged that the terminal block/conductor element assembly comprises (see FIG. 6) an operating button 360 comprising a head 360*a* accessible on the front face 360*a* and a shank 310*b* extending in the vertical direction Z-Z inside the terminal block and designed to exert a thrusting force on the second arm 112.

In a further working embodiment the end 1*a* of the wire to be inserted inside the hole 317 has a rigidity such as to press against the second arm 112 of the spring 100 without having to use auxiliary means or tools, hence the name "push-in" applied to the terminal block.

Vice versa, extraction of the wire from its seat may be performed only by means of a tool or the button 360 which, pressing against the second arm 112, frees the wire from the unidirectional retaining action exerted by the said arm.

It is therefore clear how the conductor element according to the invention is easy and inexpensive to produce and may be rapidly engaged with resilient means for unidirectionally retaining an electric wire once they are inserted inside a switchboard terminal block.

The two elements are also such that they form a stable assembly, obtained by means of a small number of manual or automatic operations, for ensuring electric conduction and retention of an electric wire; the assembly is therefore suitable for handling, storage, packaging and despatch, also separately from a terminal block for which it may be intended and without the risk of disassembly and/or relative movements of spring and conductor element, which movements during use could result in false electrical contacts and therefore malfunctioning of the terminal block once installed.

Although described in connection with a number of embodiments and a number of preferred examples of implementation of the invention, it is understood that the scope of protection of the present patent is determined solely by the claims below.

The invention claimed is:

1. A conductive assembly for switchboard terminal blocks comprising a conductor element (200) for electrically connecting together the input and output (IN/OUT) of a switchboard terminal block, and resilient means for retaining electric wires (1) comprising at least one resilient element (100) with a body (110) having a first arm (111) substantially parallel to the vertical direction (Z-Z) and a second arm (112) forming an acute internal angle with the first vertical arm (111), which arms are resiliently connected together by a curved section (113), said conductor element (200) having a substantially U-shaped form with a connection base (212) extending in a longitudinal lengthwise direction (X-X) and transverse widthwise direction (Y-Y) and with arms (211) extending parallel to a substantially vertical direction (Z-Z), which base has first slots (213) passing through in the vertical direction (Z-Z), characterized in that the arms (211) of the conductor element are situated opposite each in the longitudinal direction (X-X), in that the conductor element comprises a pair of shoulders (212) each extending from the base (212) parallel to the vertical direction (Z-Z) and arranged facing, at a suitable distance in the longitudinal direction (X-X), a respective vertical arm (211) of the conductor element;

and in that said first arm (111) of the at least one resilient element (100) has a substantially L-shaped foot (115) comprising a vertical section (115*a*) and a lug (115*b*) bent in a substantially longitudinal direction (X-X) outwards so as to be able to be inserted inside a respective slot of the first slots (213) of the base (210) for engagement with the said conductor element.

2. The conductive assembly according to claim 1, wherein the free end (211*a*) of the vertical arms (211) of the base (212) of the conductor element (200) is bent outwards at an obtuse angle so as to form a tooth designed, during use, to be inserted in a corresponding seat (315) of an insulating body (310) of the terminal block.

3. The conductive assembly according to claim 1, wherein the inner side of each vertical arm (211), facing the shoulder (212), has a knurled inside surface (211*b*).

4. The conductive assembly according to claim 1, wherein the shoulders (212) are folded from the base (210) towards the inside of the conductor element, resulting in the simultaneous formation of the slots (213) passing through in the vertical direction (Z-Z).

5. The conductive assembly according to claim 1, wherein the base has openings (214) passing through in the vertical direction (Z-Z) and suitable for engagement with jumpers (500) for connecting several terminal blocks in the transverse direction.

6. The conductive assembly according to claim 1, wherein each first slot (213) has a longitudinal dimension greater than the transverse dimension.

7. The conductive assembly according to claim 3, wherein said second arm (112) of the resilient element (100) has a free end suitable for engagement with the knurled inside surface (211*b*) of the respective vertical arm.

8. The conductive assembly according to claim 1, comprising two resilient elements (100), each engaged with a respective shoulder (212), slot (213) and vertical arm (211) of the base (210).

9. A switchboard terminal block, comprising a conductive assembly according to claim 1.

10. The switchboard terminal block according to claim 9, further comprising an insulating body with a front face (310*a*) and a first seat (315), there being arranged inside the first seat (315) a body (316) with a trapezoidal shape having a smaller base (316*a*) parallel to the longitudinal direction (X-X), height (316*b*) parallel to the vertical direction (Z-Z) and inclined face (316*c*) directed towards the side face (310*b*) of the terminal block.

11. The switchboard terminal block according to claim 10, wherein the body (316) is arranged inside the first seat (315) in a longitudinal position such as to form a first recess (316*d*) for containing a shoulder (212) of the conductor element (200) and the first vertical arm (111) of the spring (100); and a second recess (316*f*) for containing the second arm (212) of the spring (200).

12. The switchboard terminal block according to claim 10, wherein, during use, the inclined side (316*c*) of the body (316) forms an end-of-travel stop for the resilient deformation of the said second arm (112) of the spring (100).

13. The switchboard terminal block of claim 9, further comprising an operating button (360) comprising a head (360*a*) accessible on the front face (310*a*) of the terminal block and a shank (360*b*) extending in the vertical direction (Z-Z) inside the terminal block and designed to exert a thrust on the second arm (112) of the spring (100).

* * * * *